US007837441B2

(12) United States Patent
Spangler et al.

(10) Patent No.: US 7,837,441 B2
(45) Date of Patent: Nov. 23, 2010

(54) IMPINGEMENT SKIN CORE COOLING FOR GAS TURBINE ENGINE BLADE

(75) Inventors: Brandon W. Spangler, Vernon, CT (US); Dominic J. Mongillo, Jr., East Hartford, CT (US); Michael F. Blair, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 933 days.

(21) Appl. No.: 11/707,702

(22) Filed: Feb. 16, 2007

(65) Prior Publication Data

US 2008/0273963 A1 Nov. 6, 2008

(51) Int. Cl.
*F01D 5/08* (2006.01)

(52) U.S. Cl. ..... 416/97 R; 415/115

(58) Field of Classification Search ..... 415/115, 415/116; 416/92, 95, 96 A, 97 A, 97 R
See application file for complete search history.

(56) References Cited

U.S. PATENT DOCUMENTS 3,191,908 A * 6/1965 Petrie et al. ..... 416/96 R
3,806,276 A * 4/1974 Aspinwall ..... 416/97 R
4,179,240 A * 12/1979 Kothmann ..... 416/96 R
4,542,867 A * 9/1985 Memmen ..... 244/117 A
5,356,265 A 10/1994 Kercher
5,383,766 A * 1/1995 Przirembel et al. ..... 416/97 A
5,667,359 A * 9/1997 Huber et al. ..... 416/96 A
5,702,232 A * 12/1997 Moore ..... 416/95
5,720,431 A * 2/1998 Sellers et al. ..... 416/97 R
5,813,836 A * 9/1998 Starkweather ..... 416/97 R
5,931,638 A 8/1999 Krause et al.
5,976,337 A * 11/1999 Korinko et al. ..... 204/487
6,254,334 B1 * 7/2001 LaFleur ..... 415/115
6,280,140 B1 8/2001 Soechting et al.
6,331,217 B1 12/2001 Burke et al.
6,402,470 B1 6/2002 Kvasnak et al.
6,514,042 B2 2/2003 Kvasnak et al.
6,773,230 B2 * 8/2004 Bather et al. ..... 416/97 R
6,890,154 B2 5/2005 Cunha
6,896,487 B2 5/2005 Cunha et al.
7,097,425 B2 8/2006 Cunha
7,390,168 B2 * 6/2008 Liang ..... 416/97 R
7,488,156 B2 * 2/2009 Liang ..... 416/97 R
7,625,180 B1 * 12/2009 Liang ..... 416/97 R
2002/0021966 A1 2/2002 Kvasnak

* cited by examiner

*Primary Examiner*—Igor Kershteyn
(74) *Attorney, Agent, or Firm*—Carlson, Gaskey & Olds

(57) ABSTRACT

Turbine components, and in particular turbine blades, are provided with impingement cooling channels. Air is delivered along central channels, and the central channels deliver the air through crossover holes to core channels adjacent both a pressure wall and a suction wall. The air passing through the crossover holes impacts against a wall of the core channels.

16 Claims, 6 Drawing Sheets

IMPINGEMENT SKIN CORE COOLING FOR GAS TURBINE ENGINE BLADE

BACKGROUND OF THE INVENTION

This application relates to a gas turbine engine component wherein a plurality of cooling channels extend radially outwardly through an airfoil, and have crossover holes to supply impingement cooling air to both the suction and pressure walls of the airfoil.

Gas turbine engines are known, and typically include plural sections. Often a fan delivers to a compressor section. Air is compressed in a compressor section and delivered downstream to a combustor section. The compressed air is mixed with fuel and combusted in a combustor section. Products of combustion then pass downstream over turbine rotors. The turbine rotors typically receive a plurality of removable blades. The products of combustion are quite hot, and the turbine blades are subjected to high temperatures. In addition, stationary vanes are positioned adjacent to the rotor blades.

To cool the blades and vanes, cooling schemes have been developed. Air may be circulated within various cooling channels in an airfoil that defines part of the blade or vane. In many known airfoils, the cooling air flows along radial paths. Alternatively, the cooling air may flow through serpentine paths within the blade to cool the blade. With either of these schemes, cooling is more efficient near a root of the airfoil, before the air is unduly heated. Also, such paths may need to taper, as air is bled off through film cooling holes. This also results in less cooling near a tip of the airfoil.

Impingement cooling air channels have been provided adjacent a trailing edge or a leading edge of the blade. In this type channel, cooling air is received from a core and directed against an outer wall of the blade. Impingement cooling channels have generally not been used along the sides of the airfoils.

Recently, a type of cooling channel known as a "micro-circuit" has been developed. A "micro-circuit" is a very thin cooling channel formed adjacent a suction or pressure wall of the turbine blade. These channels receive cooling air from radial flow channels and perform some cooling on the suction or pressure wall. Typically, air passes through a torturous path over pedestals.

Impingement channels are simpler to manufacture than microcircuits or serpentine paths. Even so, impingement cooling has not been relied upon as essentially the exclusive mode of cooling an airfoil in the prior art.

SUMMARY OF THE INVENTION

In disclosed embodiments of this invention, cooling air is circulated through a plurality of central channels along an airfoil for a gas turbine engine component. As disclosed, the engine component is a turbine blade, however, this invention extends to vanes or other gas turbine engine components.

The cooling air passes along the central channels, and the central channels are provided with crossover holes providing the cooling air to impingement core channels adjacent both a suction and pressure wall. The cooling air passes through the crossover holes, and passes outwardly and against an opposed wall of the impingement core channel. The flow from the crossover hole to the wall is generally unimpeded, and provides impingement cooling at the wall.

In addition, film cooling holes are formed in an outer skin of the wall. The air passes through these film cooling holes to further cool an outer surface of the pressure and suction walls.

The present invention provides very efficient cooling, essentially all from impingement cooling. In addition, the relatively straight flow paths of the central channels and the impingement core channels are simpler to form than the prior art paths.

In one embodiment, each of the central channels feeds at least two sets of impingement core channels on the suction and pressure walls.

These and other features of the present invention can be best understood from the following specification and drawings, the following of which is a brief description.

DETAILED DESCRIPTION OF THE PREFERRED EMBODIMENT

Figure 1:
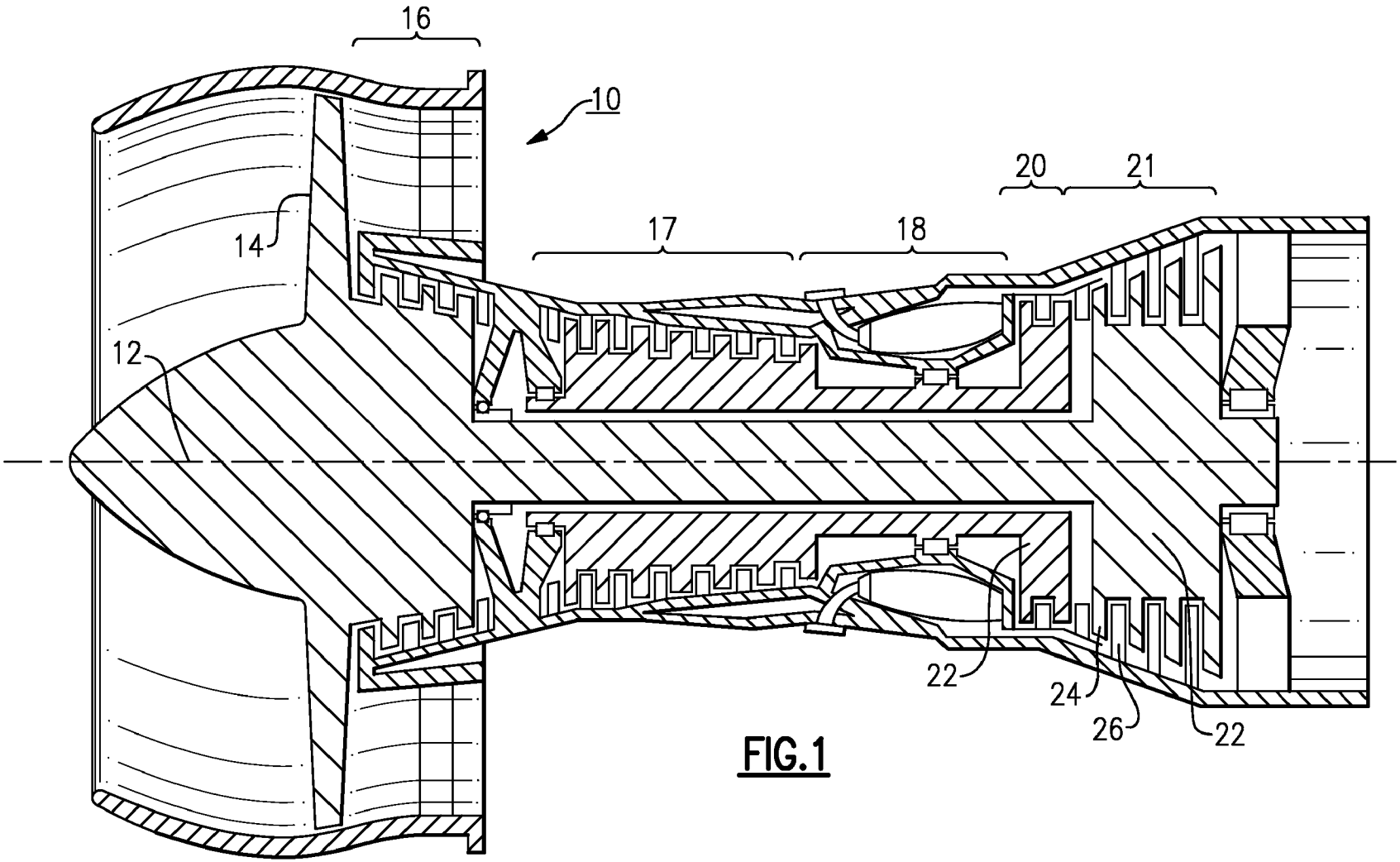
FIG. 1 schematically shows a gas turbine engine.

A gas turbine engine 10, such as a turbofan gas turbine engine, circumferentially disposed about an engine centerline, or axial centerline axis 12 is shown in FIG. 1. The engine 10 includes a fan 14, compressors 16 and 17, a combustion section 18 and turbines 20 and 21. As is well known in the art, air compressed in the compressors 16 and 17, mixed with fuel and burned in the combustion section 18 and expanded in turbines 20 and 21. The turbines 20 and 21 include rotors 22 which rotate in response to the expansion, driving the compressors 16 and 17, and fan 14. The turbines comprise alternating rows of rotating airfoils or blades 24 and static airfoils or vanes 26. In fact, this view is quite schematic, and blades 24 and vanes 26 are actually removable. It should be understood that this view is included simply to provide a basic understanding of the sections in a gas turbine engine, and not to limit the invention. This invention extends to all types of gas turbine engines for all types of applications. In fact, the invention can extend to other type turbines, such as steam turbines.

Figure 2:
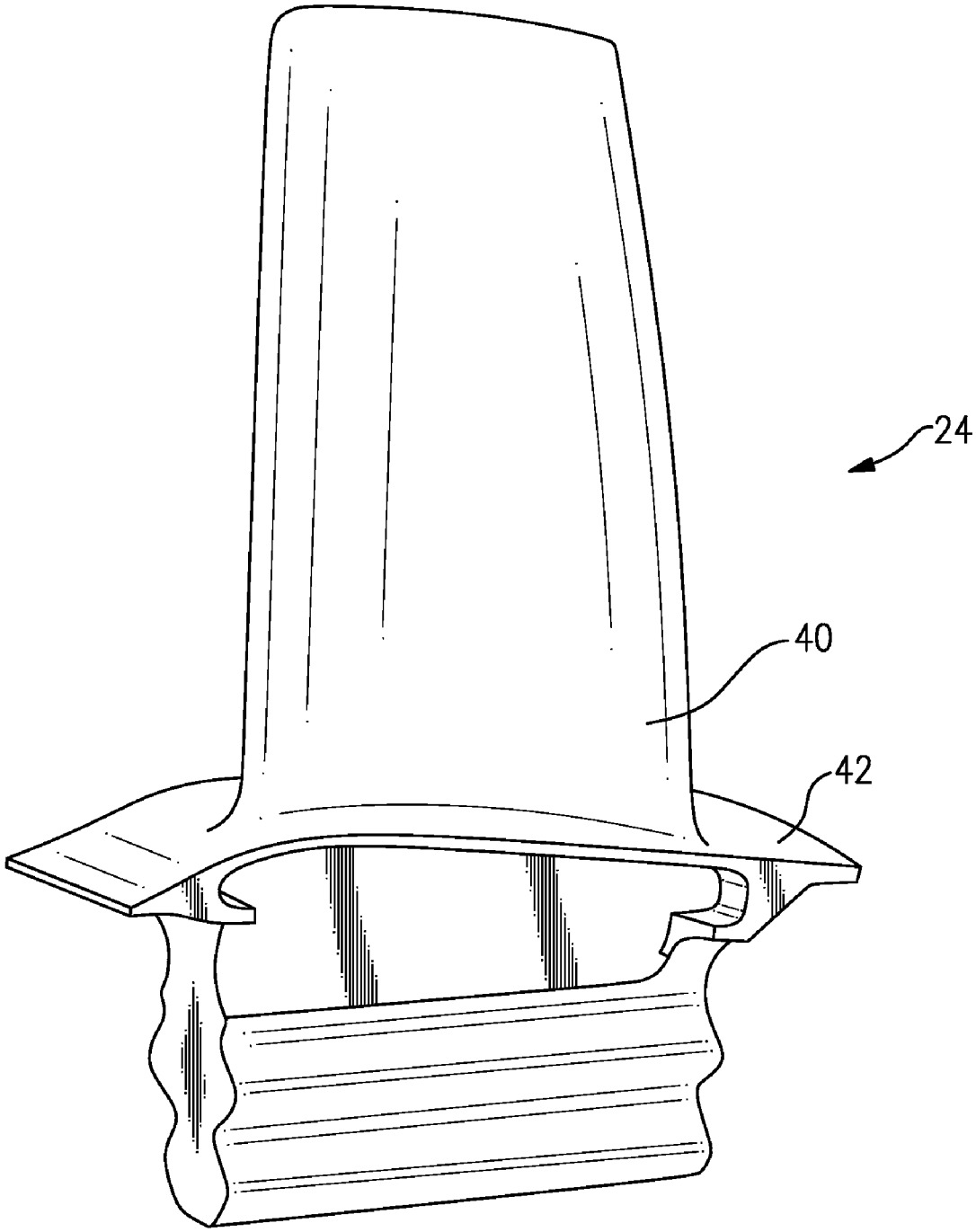
FIG.2 Prior Art
FIG. 2 schematically shows a turbine blade.
Figure 3:
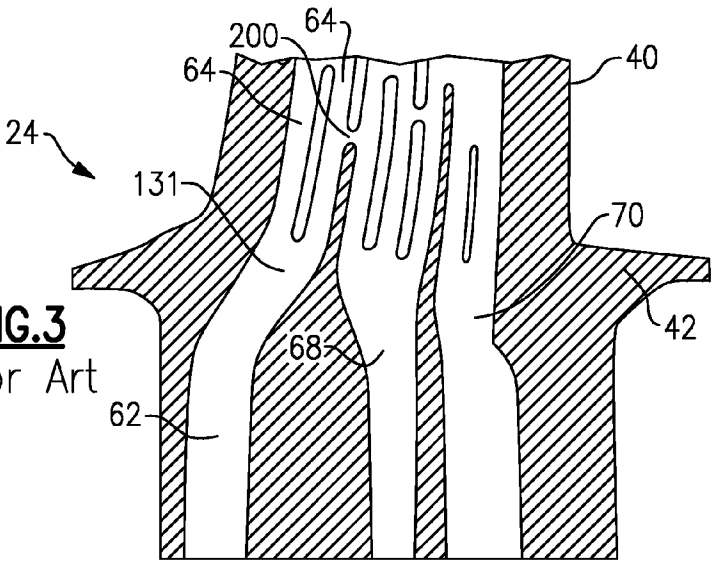
FIG.3 Prior Art
FIG. 3 is a cross-sectional view through a portion of a prior art turbine blade.

FIG. 2 shows a turbine blade 24 as known. As known, a platform 42 is provided at a radially inner portion of the blade 24, while an airfoil 40 extends radially (as seen from the centerline 12) outwardly from the platform 42. As mentioned above, it is typical to provide cooling air within the airfoil 40. Thus, as shown in FIG. 3, in the prior art turbine blade 24 there are flow channels 62, 68 and 70 that extend upwardly from the platform 42 and into the airfoil 40. These channels can be seen to cross over or overlap as shown at 64. The paths may have crossover connections 200, and may combine together to result in serpentine flow paths. It is somewhat difficult to form these internal passages.

Figure 3A:
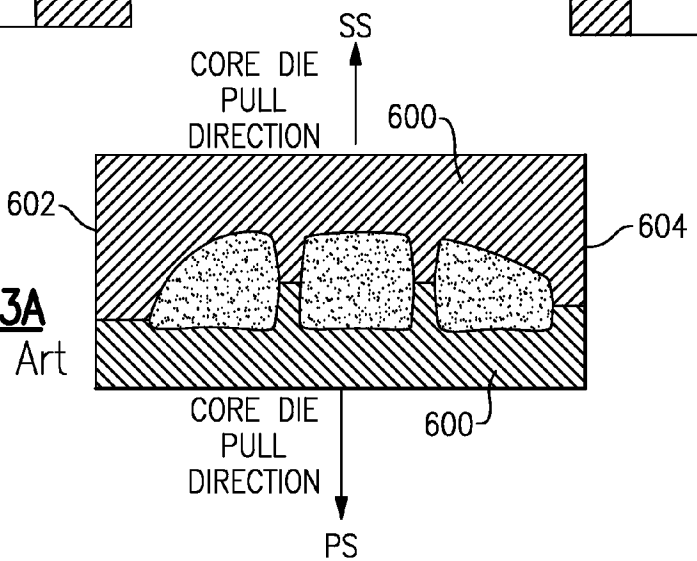
FIG.3A Prior Art
FIG. 3A shows the prior art core injection process.

FIG. 3A shows the prior art core injection process, where the parting line for two halves 600 of a metal die used to form the ceramic core runs from a leading edge 602 to a trailing edge 604. The two halves of the die are pulled normal to the pressure and suction sides of the ceramic core.

Figure 4:
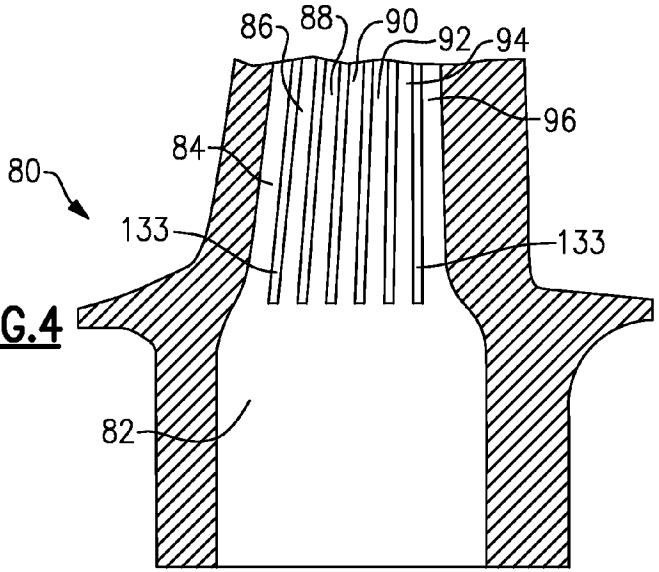
FIG. 4 is a cross-sectional view through an inventive turbine blade.

As shown in FIG. 4, the inventive turbine blade 80 has a supply 82 supplying a plurality of relatively straight central channels 84, 86, 88, 90, 92, 94 and 96.

Figure 5:
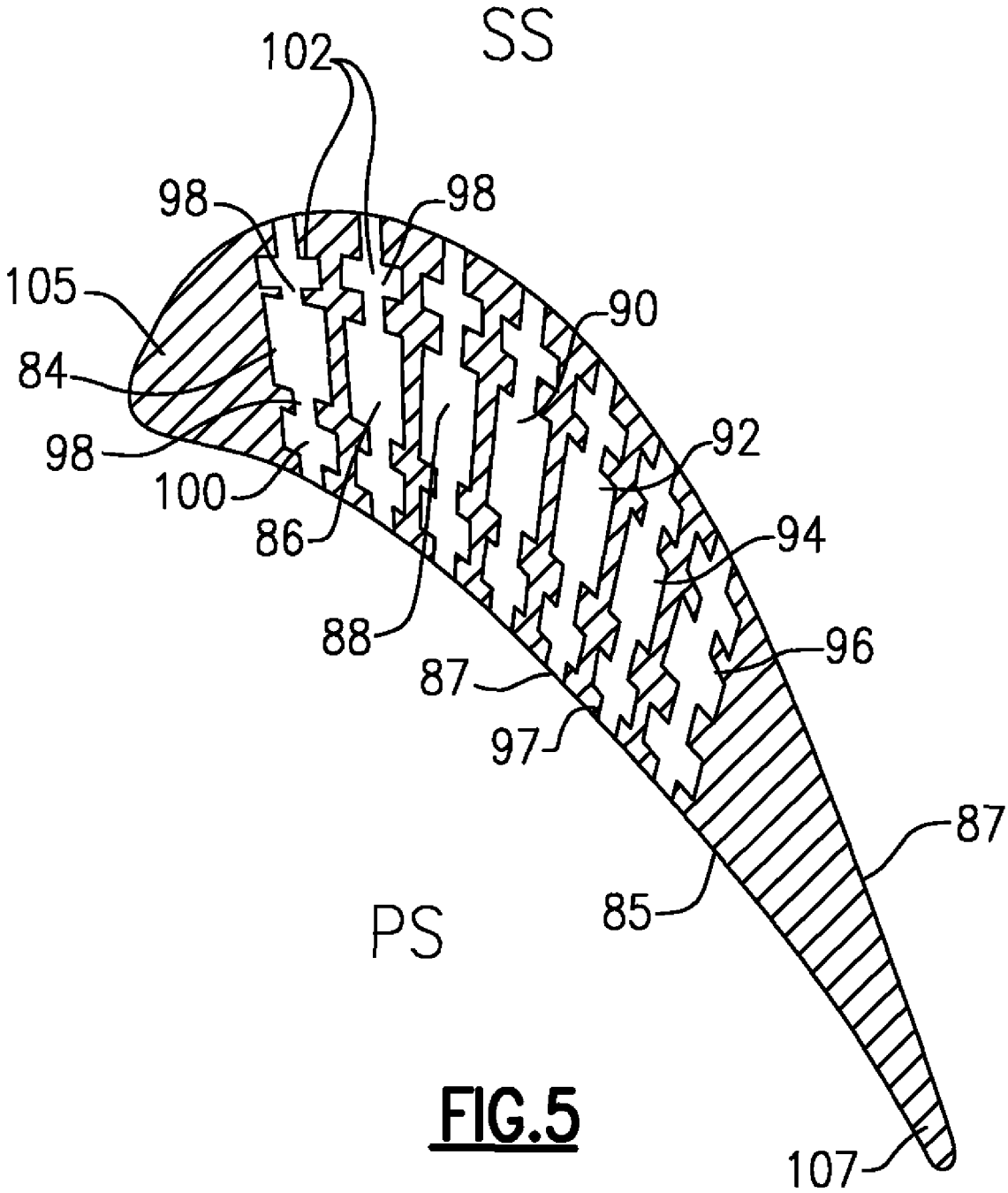
FIG. 5 is a cross-sectional view of one turbine blade according to this invention.

As shown in FIG. 5, the inventive turbine blade 80 has a pressure wall 85 and a suction wall 87. The central channels 84, 86, 88, 90, 92, 94 and 96 have crossover holes 98 on both the suction and pressure walls. The crossover holes supply cooling air to a plurality of impingement core channels 100 on the pressure wall and a plurality of impingement core channels 102 on the suction wall.

With the inventive arrangement, impingement cooling occurs on both walls, and is better adapted to adequately cool the entirety of the turbine blade. In particular, the suction and pressure walls are adequately cooled by the channels 100 and 102. Further, the crossover holes themselves provide a good deal of cooling.

While the FIG. 5 embodiment does not show leading edge 105 or trailing edge 107 cooling, it should be understood that additional cooling schemes could be provided at those locations. In general, and as can be appreciated from FIG. 5, the flow from the crossover holes 98 across to the opposed walls is generally unimpeded. Thus, the impingement cooling effect is quite efficient. Also, it can be seen that the crossover holes are smaller as measured between edges 105 and 107 than are central channels 84, 86, 88, 90, 92, 94, 96, 100 and 102.

Figure 6A:
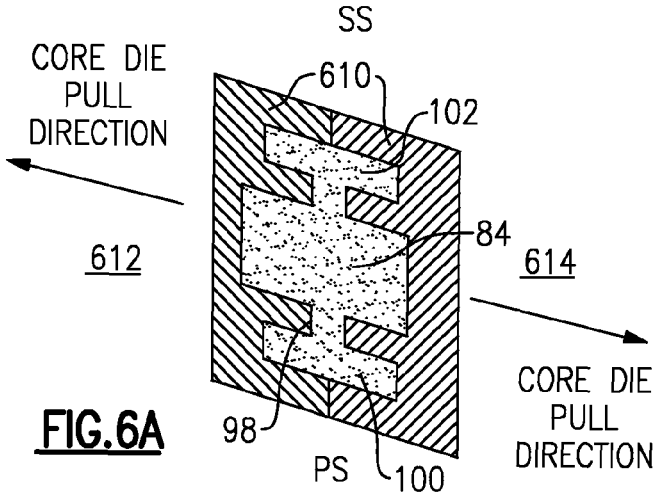
FIG. 6A schematically shows the core die for forming cores in the FIG. 5 turbine blade.
Figure 6B:
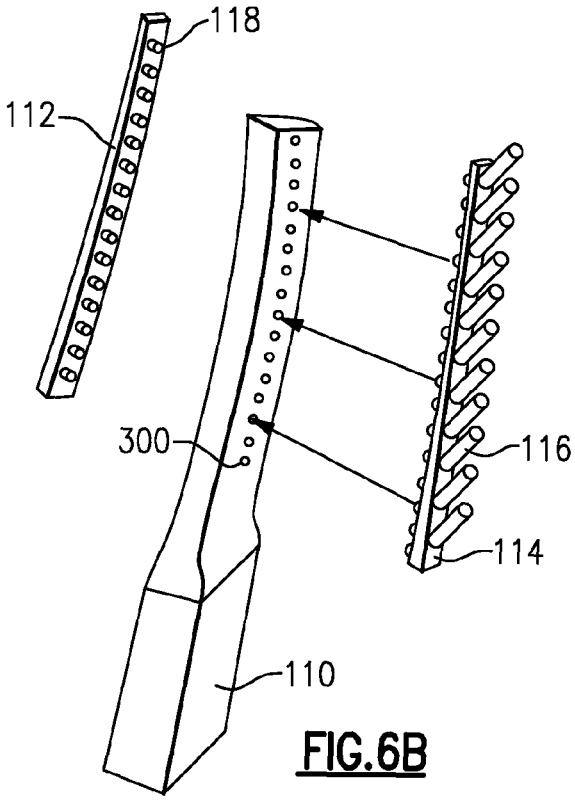
FIG. 6B schematically shows the core assembly process

The impingement channels shown in FIG. 5 can be injected as an integral part of the feed cavities, as shown in FIG. 6A, or individual cores assembled onto the feed cavity, as shown in FIG. 6B. The cores may be formed of appropriate metals or ceramic.

FIG. 6A shows how the impingement skin cores 100 and 102 can be injected as an integral part of the feed cavity 84. Instead of the parting line for the two halves of a core die running from leading edge to trailing edge, as shown in FIG. 3*a*, the parting line for the two halves 610 of the core die runs from pressure side to suction side. The two halves of the die are pulled normal to the leading 612 and trailing 614 edges of the ceramic core. Several of these cores are made in this manner and assembled in the wax die to create the cooling passages.

Figure 7:
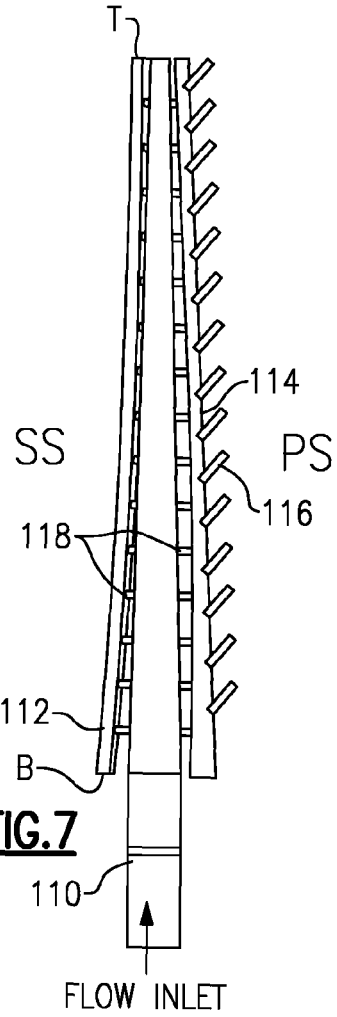
FIG. 7 shows an assembled core used in formation of the turbine blade.

FIG. 6B shows how the impingement skin cores are assembled onto the feed cavity to form the core assembly in FIG. 7 that is used in forming the FIG. 5 embodiment. Here, side pieces 112 and 114 are attached to the central core 110. Plugs 118 form the crossover holes and are received in holes 300 in central core 110. The skin cooling openings 97 shown in FIG. 5 can be drilled or formed by pins 116. Several of these cores are made in this manner and assembled in the wax die to create the cooling passages.

Figure 8:
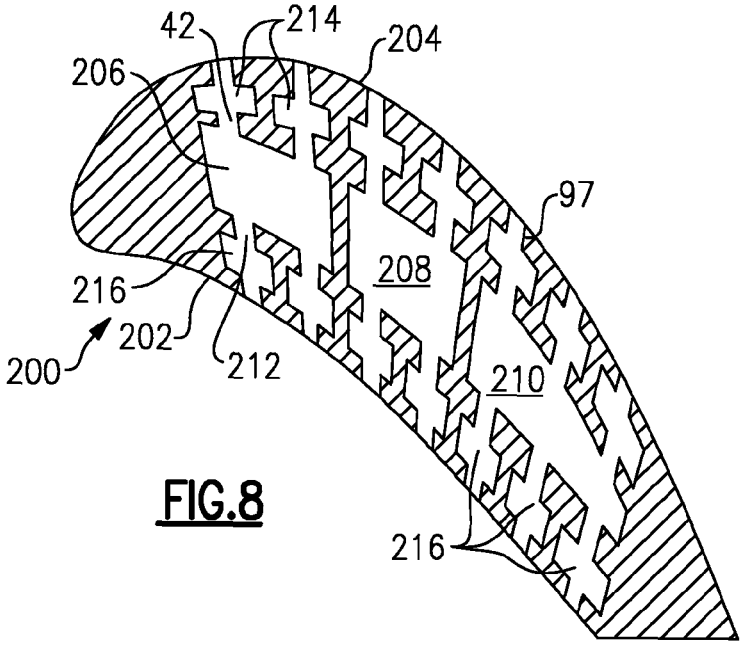
FIG. 8 is a cross-sectional view of a second embodiment.

FIG. 8 shows another embodiment 200, wherein a single central core channel supplies plural channels 214 on the suction wall 204 and plural core channels 216 on the pressure walls 202. There are central channels 206, 208 and 210 supplying sets of cores 214 and 216. As shown, at least one of the central channels 210 actually feeds three channels 216/214. Crossover holes 212 are provided as in the first embodiment.

Figure 9:
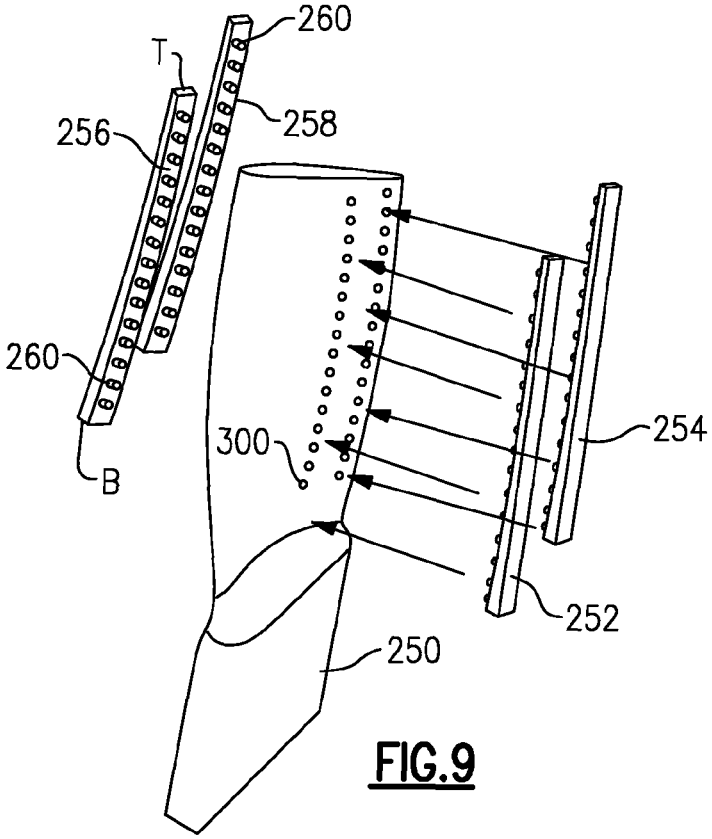
FIG. 9 shows a core assembly process for forming the second embodiment.

FIG. 9 shows the core structure 250 for forming the FIG. 8 embodiment. Here, plural side pieces 252, 254, 256 and 258 are attached to the central core 250. Plugs 260 form the crossover holes and are received in holes 300 in central core 250. Although not shown, the skin cooling openings 97 can be drilled or formed by pins similar to pins 116 (FIG. 7).

Figure 10:
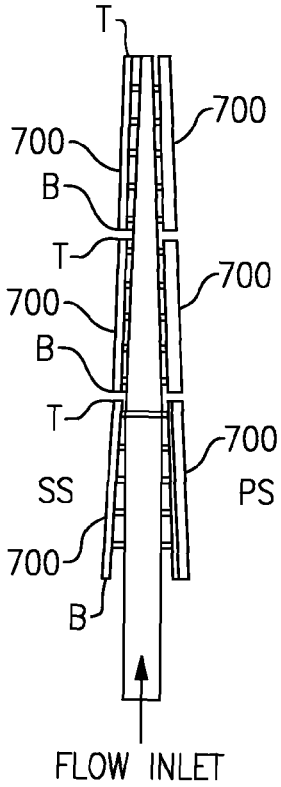
FIG. 10 shows another embodiment.

FIG. 10 shows an alternate embodiment of the invention where the impingement passages are divided into segments called boxcars 700. The cores to form such a version may have ribs to provide separation. This feature is known from leading edge impingement channels.

As can be appreciated from the shape of the side pieces in FIGS. 7, 9 and 10, the side pieces extend between a top T and a bottom B. Thus, the resultant core channels will also extend between a top and a bottom. As is clear from the illustrations of FIGS. 7, 9 and 10, the core channels are supplied entirely by the central channels, as no air flows from the platform into the side channels other than that which flows from the central channel.

The present invention thus provides an impingement cooling arrangement wherein cooling air is directed along the length of the airfoil and directed through crossover holes to impingement core channels adjacent the suction and pressure walls. The impingement air provides a good deal of cooling effect at those walls.

Although the components are illustrated as a turbine blade, it does have application as a vane or even a blade outer air seal.

The size of the crossover holes can be designed to ensure there is little radial flow in the impingement channels, or alternatively to provide for some radial flow. Also, various optional features such as trip strips, dimples, turbulators, or other heat transfer enhancing features may be used.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine engine component comprising:

a platform and an airfoil extending outwardly of the platform, the airfoil having a suction wall and a pressure wall;

a plurality of central channels received within said airfoil and extending from said platform outwardly toward a tip of said airfoil;

said central channels each being provided with plural crossover holes for directing cooling air to at least one core channel associated with each of the pressure and suction walls, and a supply to supply air to the central channels, through said crossover holes, and against a wall of said core channels;

skin cooling holes formed in said pressure and suction walls, such that the air can pass through the skin cooling holes from said core channels; and said core channels being supplied entirely from said central channel, with said core channels extending from a closed bottom wall to a top wall, with said cross-over holes supplying the impingement air into said core channels.

2. The gas turbine engine component as set forth in claim 1, wherein at least one of said central channels supplies cooling air to at least a plurality of core channels on at least one of said suction and pressure walls.

3. The gas turbine engine component as set forth in claim 2, wherein said at least one of said central channels supplies cooling air through crossover holes to plural core channels on both of said pressure and suction walls.

4. The gas turbine engine component as set forth in claim 3, wherein said at least one of said central channels supplies cooling air to at least three core channels on each of said suction and pressure walls.

5. The gas turbine engine component as set forth in claim 1, wherein said crossover holes extend for a lesser dimension than do either said central channel or said core channel measured along a distance from a leading edge of said airfoil towards a trailing edge.

6. The gas turbine engine component as set forth in claim 1, wherein the gas turbine engine component is a turbine blade.

7. The gas turbine engine component as set forth in claim 1, wherein pressure side and suction side core channels are divided into separate boxcars, and each of said separate boxcars extending from a closed bottom wall to a top wall, with said cross-over holes supplying the impingement air into each of said separate boxcars.

8. A turbine blade comprising:

a platform and an airfoil extending outwardly of the platform, the airfoil having a suction wall and a pressure wall;

a plurality of central channels received within said airfoil and extending from said platform outwardly toward a tip of said airfoil;

said central channels each being provided with plural crossover holes for directing cooling air to at least one core channel associated with each of said pressure and suction walls, and a supply to supply air received within the central channels through said crossover holes, and against a wall of said core channels;

skin cooling holes formed in said pressure and suction walls, such that the air can leave the skin cooling holes;

said crossover holes extending for a lesser dimension than do either said central channel or said core channel measured along a distance from a leading edge of said airfoil towards a trailing edge; and said core channels being supplied entirely from said central channel, with said core channels extending from a closed bottom wall to a top wall, with said cross-over holes supplying the impingement air into said core channels.

9. The turbine blade as set forth in claim 8, wherein at least one of said central channels supplies cooling air to at least a plurality of core channels on at least one of said suction and pressure walls.

10. The turbine blade as set forth in claim 9, wherein said at least one of said central channels supplies cooling air through crossover holes to plural core channels on both of said pressure and suction walls.

11. The turbine blade as set forth in claim 10, wherein said at least one of said central channels supplies cooling air to at least three core channels on each of said suction and pressure walls.

12. The turbine blade as set forth in claim 8, wherein there are pressure side and suction side core channels each divided into separate boxcars, and each of said separate boxcars extending from a closed bottom wall to a top wall, with said cross-over holes supplying the impingement air into each of said separate boxcars.

13. A gas turbine engine component comprising:

a platform and an airfoil extending outwardly of the platform, the airfoil having a suction wall and a pressure wall;

a plurality of central channels received within said airfoil and extending from said platform outwardly toward a tip of said airfoil;

said central channels each being provided with plural crossover holes for directing cooling air to at least one core channel associated with at least one of the pressure and suction walls, and a supply to supply air to the central channels, through said crossover holes, and against a wall of said core channels; and skin cooling holes formed in said pressure and suction walls, such that the air can pass through the skin cooling holes from said at least one core channel, and said at least one core channel being supplied entirely from said central channels, with said at least one core channel extending from a closed bottom wall to a top wall, with said cross-over holes supplying the impingement air into said at least one core channel.

14. The gas turbine engine component as set forth in claim 13, wherein pressure side and suction side core channels are divided into separate boxcars, and each of said separate boxcars extending from a closed bottom wall to a top wall, with said cross-over holes supplying the impingement air into each of said separate boxcars.

15. A gas turbine engine component comprising:

a body;

a plurality of central channels received within said body;

said central channels each being provided with plural crossover holes for directing cooling air to at least one core channel associated with walls of the body, and a supply to supply air to the central channels, through said crossover holes, and against one of said wall; and skin cooling holes formed in said pressure and suction walls, such that the air can pass through the skin cooling holes from said at least one core channel, and said at least one core channel being supplied entirely from said central channels, with said at least one core channel extending from a closed bottom wall to a top wall, with said cross-over holes supplying the impingement air into said at least one core channel.

16. The gas turbine engine component as set forth in claim 15, wherein pressure side and suction side core channels are divided into separate boxcars, and each of said separate boxcars extending from a closed bottom wall to a top wall, with said cross-over holes supplying the impingement air into each of said separate boxcars.

* * * * *